US007963618B2

(12) United States Patent
Stone et al.

(10) Patent No.: US 7,963,618 B2
(45) Date of Patent: Jun. 21, 2011

(54) SYSTEMS AND METHODS FOR PROVIDING AIRCRAFT RUNWAY GUIDANCE

(75) Inventors: Cyro A. Stone, Peoria, AZ (US); Richard D. Ridenour, Glendale, AZ (US); Charles C. Manberg, Peoria, AZ (US); Gregory T. Stayton, Peoria, AZ (US)

(73) Assignee: Aviation Communication & Surveillance Systems LLC, Phoenix, AZ (US)

( * ) Notice: Subject to any disclaimer, the term of this patent is extended or adjusted under 35 U.S.C. 154(b) by 11 days.

(21) Appl. No.: 11/764,742

(22) Filed: Jun. 18, 2007

(65) Prior Publication Data

US 2008/0109163 A1 May 8, 2008

Related U.S. Application Data

(63) Continuation-in-part of application No. 11/451,648, filed on Jun. 12, 2006.

(51) Int. Cl.
*G06G 7/70* (2006.01)

(52) U.S. Cl. ..... 301/16; 701/15; 342/29; 342/33

(58) Field of Classification Search ..... 342/30
See application file for complete search history.

(56) References Cited

U.S. PATENT DOCUMENTS

| | | | | |
|---|---|---|---|---|
| 6,498,981 | B1 | 12/2002 | Adams | |
| 6,531,978 | B2 | 3/2003 | Tran | |
| 6,614,397 | B2 | 9/2003 | Pullen et al. | |
| 6,911,936 | B2 | 6/2005 | Stayton et al. | |
| 7,109,889 | B2 | 9/2006 | He | |
| 2004/0030465 | A1 * | 2/2004 | Conner et al. | 701/16 |
| 2004/0225432 | A1 | 11/2004 | Pilley et al. | |
| 2004/0225440 | A1 * | 11/2004 | Khatwa et al. | 701/301 |
| 2005/0040961 | A1 * | 2/2005 | Tuttle | 340/693.3 |
| 2007/0088491 | A1 * | 4/2007 | He | 701/120 |
| 2007/0250224 | A1 * | 10/2007 | Dwyer | 701/16 |

OTHER PUBLICATIONS

Evans, Brian, "in-Trail, On-Time," Avionics Magazine, Jun. 2007, pp. 32-33, 36 & 38-39.

* cited by examiner

*Primary Examiner* — Thomas H Tarcza
*Assistant Examiner* — Timothy A Brainard
(74) *Attorney, Agent, or Firm* — Allen J. Moss; Squire, Sanders & Dempsey (US) L.L.P.

(57) ABSTRACT

There is presented a system and method for providing aircraft runway guidance. One delineated runway alert system for a host aircraft comprises: a processor for executing one or more instructions that implement one or more functions of the runway alert system; a data storage device including geographical runway information; a receiver for obtaining current location data of the host aircraft; an apparatus to provide a current heading of the host aircraft; a data entry device for receiving data indicating a desired runway; memory for storing the one or more instructions for execution by the processor to implement the one or more functions of the runway alert system to: receive the identity of the desired runway; provide an indicia of: the desired runway; and the position of the host aircraft in relation to the desired runway.

40 Claims, 9 Drawing Sheets

SYSTEMS AND METHODS FOR PROVIDING AIRCRAFT RUNWAY GUIDANCE

CROSS REFERENCE TO RELATED APPLICATIONS

This application is a continuation-in-part of and claims priority to U.S. patent application No. 11/451,648, filed Jun. 12, 2006, which was filed by three common inventors, and the disclosure of which is fully incorporated herein by reference for all purposes.

DESCRIPTION OF THE INVENTION

1. Field of the Invention

The present invention relates to aircraft runway guidance systems and methods, and more particularly, to systems and methods for guiding a host aircraft to an appropriate runway for takeoff or landing.

2. Background of the Invention

Traditionally, flight crews have visually sighted traffic on or near a runway and/or received VHF/UHF communications from air traffic control prior to takeoff to attempt to prevent collisions. There has been no visual or aural indication in the cockpit of other traffic, objects or features on the ground for an independent situational awareness assessment by the flight crew.

As shown in FIG. 1, at times it is difficult if not impossible to see traffic on or near the runway at long distances. Due to the nighttime and foggy conditions depicted in FIG. 1, this aircraft waiting to take off could not see traffic on the ground further down range along the edge of the runway and therefore started its takeoff.

FIG. 2 shows how close the aircraft that was waiting to take off in FIG. 1 came to colliding with the aircraft that was initially unseen to the aircraft taking off. As shown in FIG. 2, the aircraft on the ground is now crossing the runway and its presence is known to the aircraft taking off, however, due to poor visibility, the aircraft taking off did not foresee this collision threat as it waited to take off, as shown in FIG. 1. When this event occurred, the aircraft range at closest point of approach was approximately 80 feet. Moreover, the flight crew had to prematurely climb off the runway and nearly stalled and crashed after missing the aircraft crossing the runway in front of it.

Thus, there is a need for systems and methods that may provide visual and/or aural indications in the cockpit of other traffic, objects or features on the ground for an independent situational awareness assessment by the flight crew.

Further, with the increasingly complex geometry of multiple-runway airports, aircraft accidents can and have also occurred when a pilot has attempted to use a runway for take-off or landing that is not the designated runway for that aircraft. On occasion, pilots unfamiliar with airport terrain may even mistake taxiways for runways. Therefore, what is needed is a system to provide an indicator to a pilot to prevent that pilot from attempting to take off on an inappropriate runway, and to illustrate the appropriate and desired runway.

SUMMARY OF THE INVENTION

In accordance with an embodiment of the invention, a collision avoidance system is disclosed for a host aircraft on the ground, the system comprising a processor for executing one or more instructions that implement one or more functions of the collision avoidance system, a transceiver for transmitting information from and receiving information for the host aircraft, and memory for storing the one or more instructions for execution by the processor to implement the one or more functions of the collision avoidance system to: receive from the transceiver information from another aircraft, generate from the received information a track for the other aircraft, and determine whether the track will intersect within a predefined period of time a region of interest around the host aircraft.

In this embodiment of the invention, the memory may store further instructions for execution by the processor to implement the one or more functions of the collision avoidance system to display on a cockpit display in the host aircraft the track if the track will intersect within the predefined period of time the region of interest around the host aircraft. The memory may store further instructions for execution by the processor to implement the one or more functions of the collision avoidance system to determine whether the track will intersect within another predefined period of time a collision avoidance region of interest around the host aircraft, after the initial determination indicates that the track will intersect within the predefined period of time the region of interest around the host aircraft. The memory may store further instructions for execution by the processor to implement the one or more functions of the collision avoidance system to generate a signal for proving one or more of an aural alert and a visual alert within host aircraft, after the system determines that the track will intersect within the other predefined period of time the collision avoidance region of interest around the host aircraft.

Still referring to this embodiment of the invention, the region of interest around the host aircraft may be larger than or equal to the collision avoidance region of interest around the host aircraft. The determination of whether the track will intersect within the predefined period of time the region of interest around the host aircraft may employ a region of interest around the track. Also, the determination of whether the track will intersect within the other predefined period of time the collision avoidance region of interest around the host aircraft may employ a region of interest around the track. The transceiver may comprise a separate receiver and a separate transmitter. The memory may store further instructions for execution by the processor to implement the one or more functions of the collision avoidance system to display on a cockpit display in the host aircraft ground data that is descriptive of any feature of the ground or any vehicle on the ground.

In accordance with another embodiment of the invention, a collision avoidance system is disclosed for a host aircraft on the ground, the system comprising a processor for executing one or more instructions that implement one or more functions of the collision avoidance system, a transceiver for transmitting information from and receiving information for the host aircraft, a display, and memory for storing the one or more instructions for execution by the processor to implement the one or more functions of the collision avoidance system to: determine whether a predefined condition is satisfied, and change an appearance of a symbol shown on the display to indicate that the predefined condition is satisfied.

In this embodiment of the invention, the determination of whether a predefined condition is satisfied may employ information received by the transceiver. The predefined condition may be any that may affect safe operation of the host aircraft. The symbol may comprise a representation of anything on the ground. The representation of anything on the ground may include one or more of a representation of the host aircraft, a representation of any other aircraft, a representation of any vehicle other than an aircraft, and a representation of any ground feature. The representation of any ground feature may include a representation of any place that an aircraft is supposed to go or a representation of anyplace that an aircraft is not supposed to go.

In accordance with yet another embodiment of the invention, a method of operating a collision avoidance system is disclosed for a host aircraft on the ground, the method comprising determining whether a predefined condition is satisfied and changing an appearance of a symbol shown on a display in the host aircraft to indicate that the predefined condition is satisfied.

In this embodiment of the invention, the determination of whether a predefined condition is satisfied may employ information received by a transceiver. The predefined condition may be any that may affect safe operation of the host aircraft. The symbol may comprise a representation of anything on the ground. The representation of anything on the ground may include one or more of a representation of the host aircraft, a representation of any other aircraft, a representation of any vehicle other than an aircraft, and a representation of any ground feature. The representation of any ground feature may include a representation of any place that an aircraft is supposed to go or a representation of any place that an aircraft is not supposed to go.

In another embodiment, a multifunction display is provided in the host aircraft that may render a map of an airport on a cockpit display, and may allow input through a device such as a touch screen or external integrated or non-integrated keypad. The pilot may select a runway to be used for takeoff or landing, or the appropriate runway may be selected by the host aircraft receiving such a designation from another system (for example, but not by way of limitation, a flight management system or ACARS uplink from a ground station). Once the runway designation is received, the desired takeoff/landing runway may be highlighted on the display to guide the pilot to the appropriate runway.

There is also provided a method and system for guiding a pilot to a correct runway and, optionally, to inform the pilot if state data obtained from the host aircraft indicate that the aircraft might be about to attempt a takeoff or a landing on a runway that is different from a designated runway. Visual and/or aural alerts may be provided to a pilot when a wrong runway takeoff or landing is attempted, and when conditions indicate that the host aircraft is no longer attempting takeoff or landing on the unauthorized runway, the alerts cease to be generated. One delineated runway alert system for a host aircraft comprises: a processor for executing one or more instructions that implement one or more functions of the runway alert system; a data storage device including geographical runway information; a receiver for obtaining current location data of the host aircraft; an apparatus to provide a current heading of the host aircraft; a data entry device for receiving data indicating a desired runway; memory for storing the one or more instructions for execution by the processor to implement the one or more functions of the collision avoidance system to: receive the identity of the desired runway; provide an indicia of: the desired runway; and the position of the host aircraft in relation to the desired runway.

Still referring to this embodiment, the system may further comprise a runway alert system for a host aircraft wherein memory stores further instructions for execution by the processor to implement the one or more functions of the runway alert system to determine that the host aircraft is being positioned for takeoff on an undesired runway. Further, in this embodiment, the memory may store further instructions for execution by the processor to implement the one or more functions of the runway alert system to determine from the current location data, the current heading, the identity of the desired runway, and the geographical runway information, that a predetermined threshold has been satisfied, and thereupon, providing within the host aircraft one or more of an aural alert or a visual alert. In one approach, the present embodiment implements one or more functions of the runway alert system to determine that: the host aircraft is within a predetermined proximity of an undesired runway; and the angular difference between the current heading and the heading necessary to take off on the undesired runway is within a predetermined heading difference threshold.

Another embodiment provides a runway alert system for a host aircraft on the ground, the system comprising: a processor for executing one or more instructions that implement one or more functions of the runway alert system; a data storage device including at least 2-dimensional geographical airport runway and taxiway information; a receiver for obtaining current location data of the host aircraft; an inertial reference system to provide a current heading and ground speed of the host aircraft; a data entry device for receiving data indicating a desired runway; a transducer for providing aural alerts; a display for illustrating a current position of the host aircraft in relation to at least one runway; and memory for storing the one or more instructions for execution by the processor to implement the one or more functions of the runway alert system to: receive the identity of the desired runway; render, on the display: a depiction of an overhead map of an airport including the desired runway; a visually distinct depiction of the desired runway; and a position of the host aircraft in relation to the desired runway; and determine that a predetermined threshold has been satisfied, and thereupon, providing within the host aircraft one or more of an aural alert or a visual alert.

In yet another embodiment, a method provides runway guidance for a host aircraft on the ground, comprising: receiving an indication of a desired takeoff or landing runway; obtaining a current position of the host aircraft; determining whether a predefined condition is satisfied; and changing an appearance of a display in the host aircraft to indicate that the predefined condition is satisfied. In one implementation, the predetermined condition is triggered when it is determined that the host aircraft is within a predetermined distance of an entrance to one of the undesired runways and is assuming a heading that would allow an aircraft to traverse the one of the undesired runways. In other embodiments, a predetermined condition may be triggered when the host aircraft is nearing an entry to an undesired runway and the speed of the aircraft slows to a speed consistent with use of the undesired runway.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present exemplary embodiments of the invention, examples of which are illustrated in the accompanying drawings. Wherever possible, the same reference numbers will be used throughout the drawings to refer to the same or like parts.

Embodiments of the invention may provide flight crews with means to visually and/or aurally detect any vehicle on the ground, e.g., on or near a runway or a taxiway, to provide situational awareness that can be used to prevent vehicle collisions. As used herein, "vehicle" or "vehicles" may refer to any moveable object, such as an aircraft or any ground support equipment. Such situational awareness may similarly be provided for non-moveable objects or features, as well as for any vehicles, objects or features that are not on the ground. Also as used herein, the terms "host aircraft" and "own aircraft" may be considered interchangeable. Also as used herein, the term "traverse" means to travel over a substantial portion of a referenced area, especially a particularly elongate region, and need not require traveling down the entire length of the major axis of an elongate region.

Figure 1:
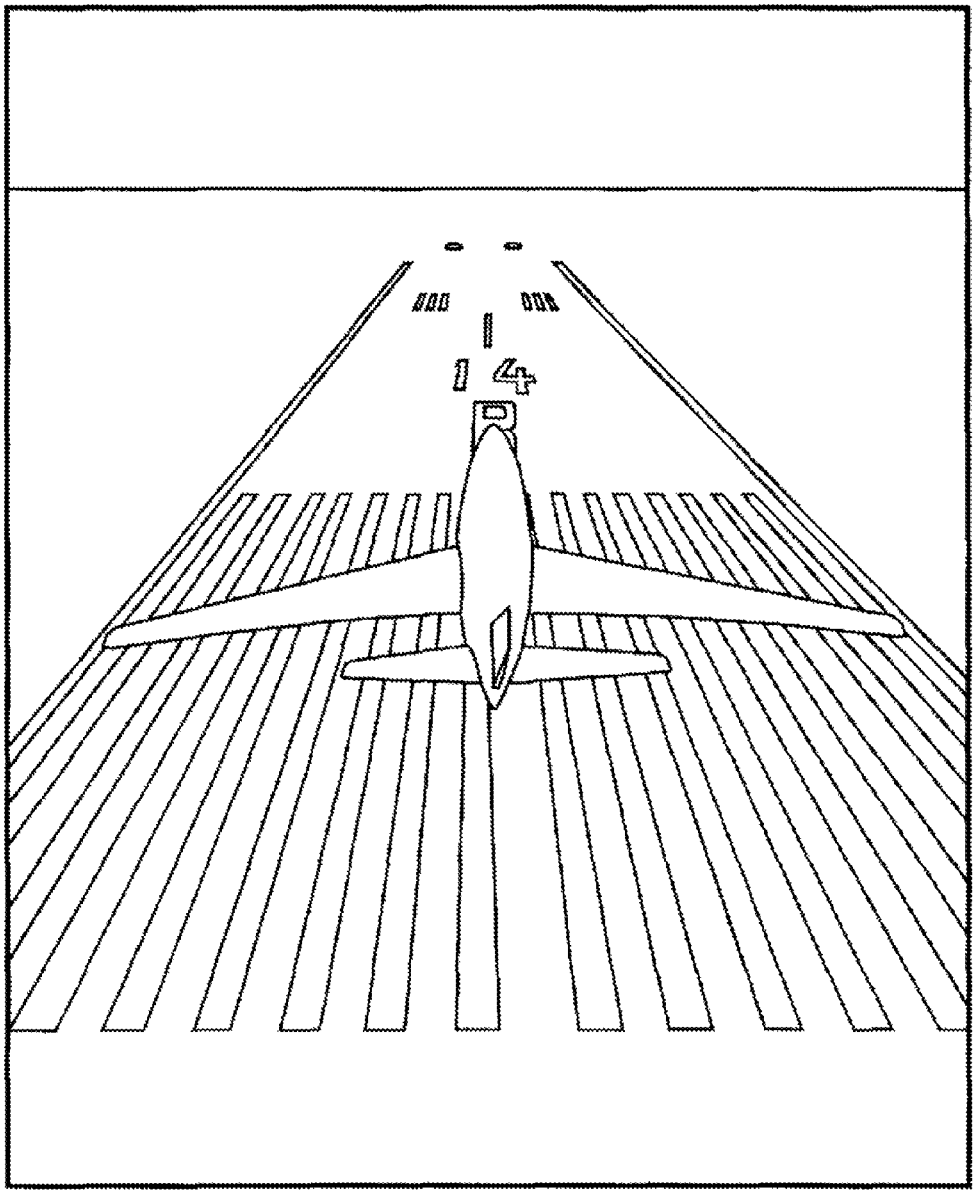
FIG. 1 is a perspective view of an aircraft waiting to take off and not able to see traffic on the ground further down the runway.
Figure 2:
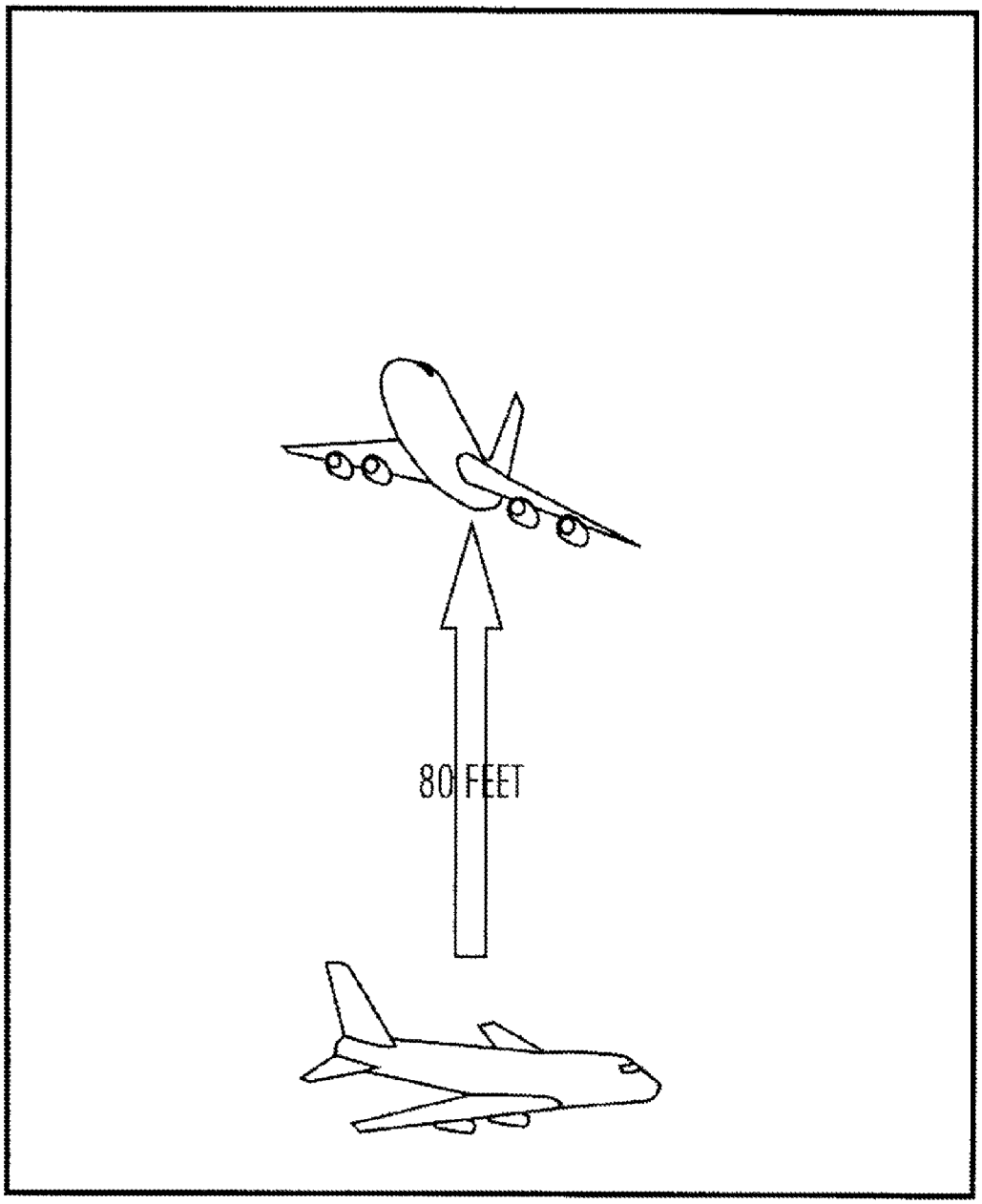
FIG. 2 is a perspective view of the aircraft of FIG. 1, now shown down the runway and dangerously close to another aircraft that intruded on the runway.
Figure 3:
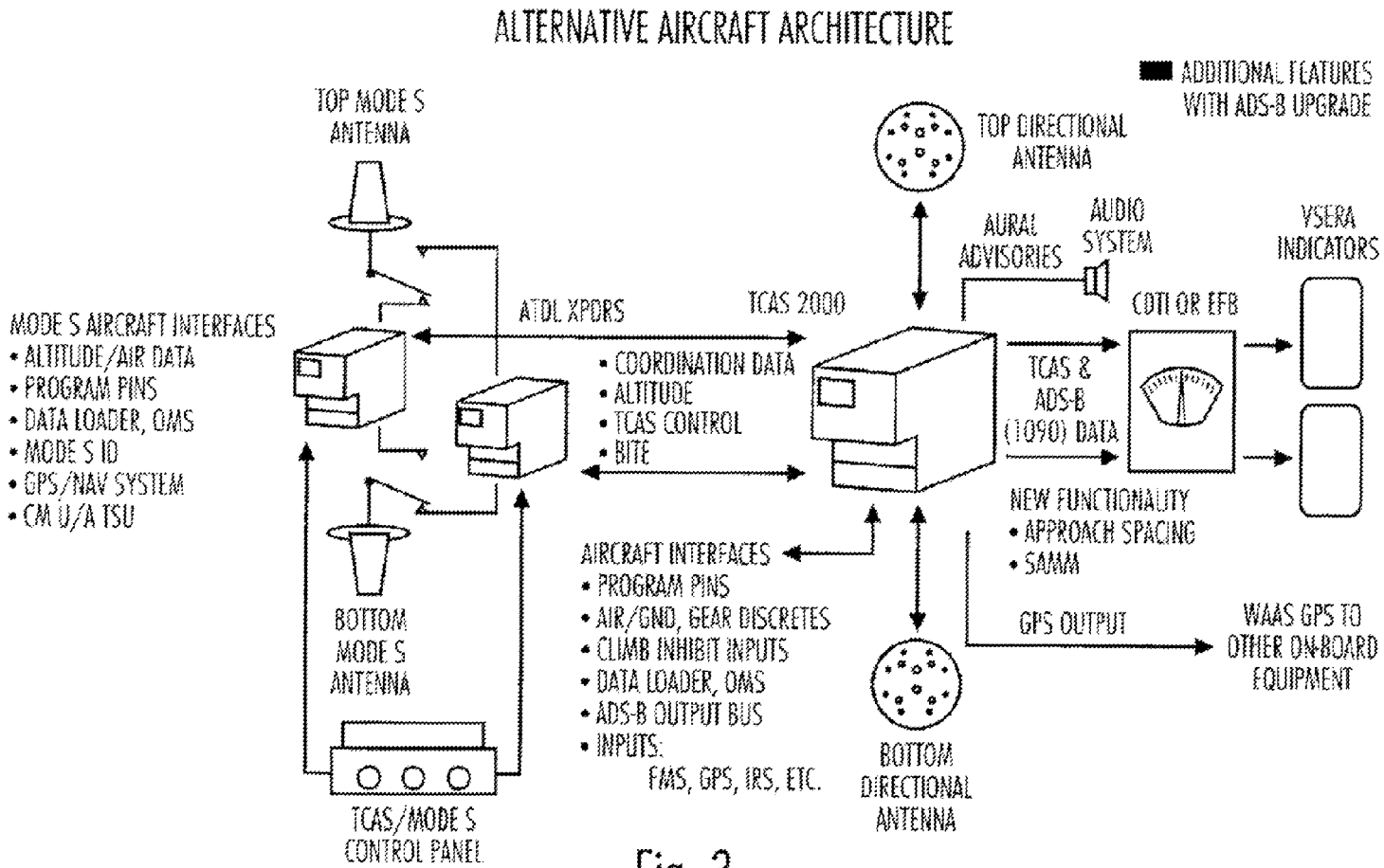
FIG. 3 is a system diagram showing elements of a collision avoidance system that may be employed, in accordance with systems and methods consistent with the present invention.

FIG. 3 shows one possible system that may be used with embodiments of the invention. Mode S transponders can be used between some or all vehicles to send messages about the position of one's own vehicle, e.g., aircraft, to other vehicles. These messages can then be received by a TCAS computer unit and processed to provide a display to the flight crew of the vehicles within a predefined range. A database can also be hosted in the TCAS computer unit or supplied by an external device through an external bus to provide the flight crew with a depiction of airport geography, including but not limited to runways and taxiways.

Figure 4:
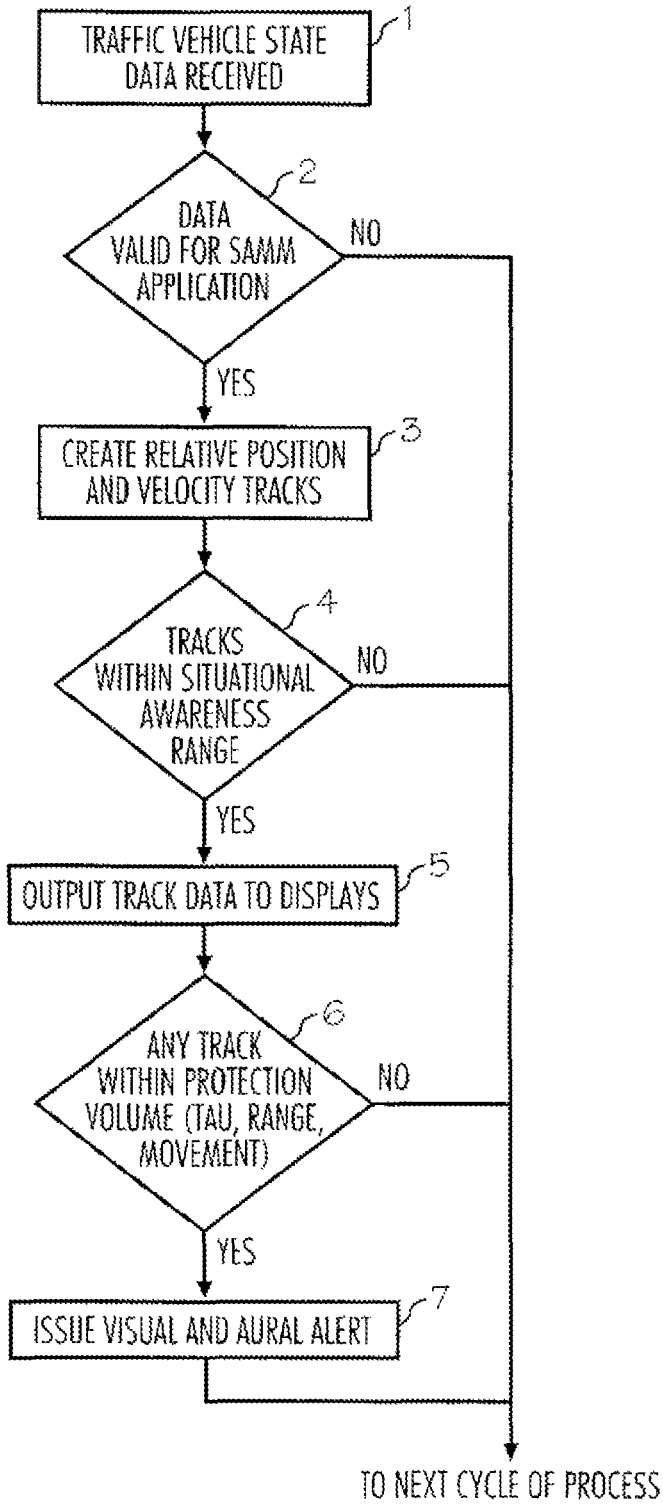
FIG. 4 is a flowchart diagram showing a process that may be employed in a collision avoidance system, in accordance with systems and methods consistent with the present invention.

FIG. 4 depicts a process that may be performed by the system of FIG. 3, however, those skilled in the art understand that variations to the system may be made while still employing the process of FIG. 4. Software to perform the process of FIG. 4 may be stored in memory anywhere in the system and executed by one or more processors.

Referring to FIG. 4, in step 1 the system may receive traffic vehicle state data that may include any data concerning a vehicle that may be relevant to the safety and/or situational awareness of another aircraft receiving such data. For example, this data may include but is not limited to position, velocity, flight identification, altitude, on ground or airborne status, aircraft type, and the like.

In step 2, a determination may be made as to the validity of the received data. For example, the system may evaluate the reasonableness of the data, i.e., is all the data consistent for each scan under normal conditions. Such reasonableness determinations may involve any received data, such as instantaneous acceleration, velocity, update rates and minimum/maximum values. A validity determination may also include an integrity check of any of the received data, i.e., checking that the data is accurate and believable, according to predetermined standards. A validity determination may also verify that data update rates are appropriate under the circumstances, so, for example, data is not too old for a given set of conditions. A validity determination may also verify that data is complete. Data passing selected validity tests may be employed by subsequent steps in the process, however, invalid data is not so used and the process may return to step 1.

In step 3, the system may take own aircraft's position and velocity data and compare this to other aircraft's position and velocity data to determine relative ranges, bearings, and altitudes (for the case where aircraft are airborne) to provide indications to the flight crew of where other aircraft are relative to own aircraft, which can be used to establish tracks for situational awareness purposes. Such processing may employ any suitable algorithm, e.g., a haversine formula or, for close ranges, a latitude/longitude subtraction between own aircraft and other aircraft, to determine the relative position between own aircraft and other aircraft. Velocity information can be used to provide an indication to the flight crew that another aircraft is moving and thus its position is changing relative to a fixed position object, such as a runway or a taxiway, and relative to own aircraft, whether moving or not. For instance, if velocity of own aircraft relative to another aircraft (or of the other aircraft relative to own aircraft) is toward (as opposed to away) from each other, this can be used to enhance situational awareness.

In step 4, the system may determine whether the determined tracks are within a defined situational awareness region, i.e., one that is meaningful for the safety of the flight crew and its passengers and cargo. To this end, a geometric awareness shape could be used. A geometric awareness shape may comprise any desired shape or symbol, such as an elliptical shape. Assuming that an elliptical awareness shape is employed, the major axis thereof may overlap any perceived danger zone, e.g., an active runway. In other words, the geometric awareness shape may be employed to avoid danger and one may select the shape and its manner of employment to focus on areas of perceived danger, while having less of the awareness shape focused on areas of lesser perceived danger. Thus, returning to the elliptical shape example, the major axis thereof may extend down some predefined distance in front of own aircraft when the aircraft is on an active runway or facing the active runway, i.e., an active runway is a perceived danger zone. The minor axis of the elliptical shape may extend some predefined distance, e.g., half the width of the runway, from the side of the aircraft. Alternatively, when an aircraft is not on a runway, e.g., on a taxiway or waiting to enter a runway, the major and minor axes of the awareness ellipse may be reversed. In this way, the major axis of the awareness shape may be focused toward higher perceived threats, e.g., an active runway. If the determined tracks are within a situational awareness region, e.g., a geometric awareness shape, the process may proceed to step 5 for such tracks, and if not, to step 1.

In step 5, the system may provide an output to any annunciating and/or display device which can then provide indications to the flight crew of the surrounding vehicular traffic, objects or features for situational awareness. The annunciating and/or displaying preferably concerns tracks within the situational awareness region, however, those outside this region may similarly be announced and/or displayed.

In step 6, the system may use the information previously provided, e.g., by steps 1 and 3, to evaluate whether the position, movement, track or other spatial criteria of a vehicle, object or feature is within a protection volume around own aircraft. A protection volume can be used, such as an ellipse (if in two dimensions), where own aircraft's course and speed may be used to extend the protection volume along own aircraft's track. This protection geometry can then be used to determine if it overlaps any other aircraft, object or feature (or a similar protection volume for the other aircraft, object or feature) at a Tau or time projected into the future, such as 30 seconds, to determine if a possible collision might occur.

In step 7, the system may examine the output of step 6 and, if an alert is required, provide an aural and/or visual alert to the flight crew to enhance situational awareness in an effort to prevent collision of own aircraft with another vehicle, object or feature.

The process of FIG. 4 may use any data relevant to the purposes of enhancing flight crew situational awareness and aircraft safety, which may include data described above and further include: (1) airport surface area map data—data such as runway location, runway hold lines on the taxiways, etc.; (2) traffic aircraft state data—data such as aircraft position, heading and velocity (ground speed); and (3) own aircraft data—data such as aircraft position, heading, velocity (ground speed).

Display symbols may draw distinction between different types of safety scenarios, e.g., a normal condition for own aircraft, a cautionary condition for own aircraft and a warning condition for own aircraft.

For example, an own aircraft symbol when own aircraft is in a normal condition may comprise a first state, e.g., a predefined shape and/or color (white).

Display symbols for ground traffic, i.e., other vehicles, when in a normal condition, e.g., no active runway encroachment, may comprise a second state, e.g., a predefined shape and/or color (tan).

Display symbols for ground traffic, i.e., other vehicles, when not in a normal condition, e.g., active runway encroachment, may comprise a third state, e.g., a predefined shape and/or color (yellow, signifying a cautionary advisory condition), assuming that own aircraft is on the active runway, but stopped. Similarly, display symbols for ground traffic, i.e., other vehicles, when not in a normal condition, e.g., own aircraft has crossed a runway "Hold Short" IFR line on the taxiway and the ground traffic is on the active runway with no velocity, may comprise a third state, e.g., a predefined shape and/or color (yellow, signifying a cautionary advisory condition). In such cases, the display of the runway itself may also, or alternatively, change appearance to draw the attention of the flight crew, e.g., the displayed runway may be highlighted or outlined in yellow and/or start blinking.

Display symbols for ground traffic, i.e., other vehicles, when not in a normal condition, e.g., active runway encroachment, may comprise a fourth state, e.g., a predefined shape and/or color (red, signifying a warning advisory condition), assuming that own aircraft is on the active runway, but not stopped, e.g., taking off. Similarly, display symbols for ground traffic, i.e., other vehicles, when not in a normal condition, e.g., when own aircraft crosses the runway "Hold Short" IFR line on the taxiway and the ground traffic is on the active runway and not stopped, may comprise a fourth state, e.g., a predefined shape and/or color (red, signifying a warning advisory condition). In such cases, the display of the runway itself may also, or alternatively, change appearance to draw the attention of the flight crew, e.g., the displayed runway may be highlighted or outlined in red and/or start blinking.

An active runway may also be displayed with a unique predefined characteristic. For example, an active runway may be highlighted in yellow or in a yellow outline (a cautionary advisory condition) when own aircraft is pointed towards the runway and is behind or crosses the runway "Hold Short" IFR line on the taxiway and traffic is on the active runway with no velocity. Similarly, an active runway may be highlighted in red or in a red outline (a warning advisory condition) when own aircraft is pointed towards the runway and is behind or crosses the runway "Hold Short" IFR line on the taxiway and traffic is on the active runway with velocity.

Accordingly, the system may provide aural and/or visual indications to enhance the situational awareness and safety of own aircraft relative to other vehicles, objects or features, whether moving or not and whether on the ground or not.

For example, when own aircraft is on an active runway with no velocity and traffic crosses the active runway "Hold Short" IFR line for that runway, the display symbol for the traffic may assume a predefined shape and/or color (yellow, signifying a cautionary advisory condition). The display symbol for the traffic can change back to a predefined shape and/or color (tan, signifying a normal condition) when it returns to a safe position, such as after own aircraft has passed by the traffic or when the traffic has crossed and is moving away from the runway.

When own aircraft is on an active runway with a velocity and traffic crosses the active runway "Hold Short" IFR line for that runway, the display symbol for the traffic may assume a predefined shape and/or color (red, signifying a warning advisory condition). The display symbol for the traffic can change back to a predefined shape and/or color (tan, signifying a normal condition) when it returns to a safe position, such as after own aircraft has passed by the traffic or when the traffic has crossed and is moving away from the runway.

When own aircraft is on a taxiway that is pointing towards an active runway and own aircraft is behind the active runway "Hold Short" IFR line and traffic is on the active runway with no velocity, the display symbol for the traffic may assume a predefined shape and/or color (yellow, signifying a cautionary advisory condition). Similarly, in such a condition, the display symbol for the active runway may also assume a predefined shape and/or color (yellow highlight or yellow outline, signifying a cautionary advisory condition). Once the traffic crosses a predefined safety threshold, e.g., a set altitude above the ground after takeoff, the display symbol for the traffic and/or the active runway may return to a normal indication.

When own aircraft is on a taxiway that is pointing towards an active runway and own aircraft is behind the active runway "Hold Short" IFR line and traffic is on the active runway with velocity, the display symbol for the traffic may assume a predefined shape and/or color (red, signifying a warning advisory condition). Similarly, in such a condition, the display symbol for the active runway may also assume a predefined shape and/or color (red highlight or red outline, signifying a warning advisory condition). Once the traffic crosses a predefined safety threshold, e.g., a set altitude above the ground after takeoff, the display symbol for the traffic and/or the active runway may return to a normal indication.

When own aircraft is on a taxiway that is pointing towards an active runway and own aircraft crosses the runway "Hold Short" IFR line and traffic is on the active runway with no velocity, the display symbol for the traffic may assume a predefined shape and/or color (yellow, signifying a cautionary advisory condition). Similarly, in such a condition, the display symbol for the active runway may also assume a predefined shape and/or color (yellow highlight or yellow outline, signifying a cautionary advisory condition). Once the traffic crosses a predefined safety threshold, e.g., a set altitude above the ground after takeoff, the display symbol for the traffic and/or the active runway may return to a normal indication.

When own aircraft is on a taxiway that is pointing towards an active runway and own aircraft crosses the runway "Hold Short" IFR line and traffic is on the active runway with velocity, the display symbol for the traffic may assume a predefined shape and/or color (red, signifying a warning advisory condition). Similarly, in such a condition, the display symbol for the active runway may also assume a predefined shape and/or color (red highlight or yellow outline, signifying a warning advisory condition). Once the traffic crosses a predefined safety threshold, e.g., a set altitude above the ground after takeoff, the display symbol for the traffic and/or the active runway may return to a normal indication.

With the increasingly complex geometry of multiple-runway airports, aircraft accidents can and have occurred when an aircraft has attempted to use a runway for take-off or landing that is not the designated runway for that aircraft. On occasion, pilots unfamiliar with airport terrain may potentially mistake taxiways for runways. Therefore, embodiments of the present invention describe a method and system for signaling if the aircraft might be about to attempt a takeoff or a landing on a runway that is different from a designated runway. One object of embodiments of the present invention is to provide information to the flight crew prior to the point when an actual takeoff or landing is attempted on the wrong runway. Of further benefit, embodiments the present invention help the pilot to avoid beginning dangerous maneuvers by providing predictive indications to the pilot that a dangerous maneuver is perhaps about to be performed.

Figure 5:
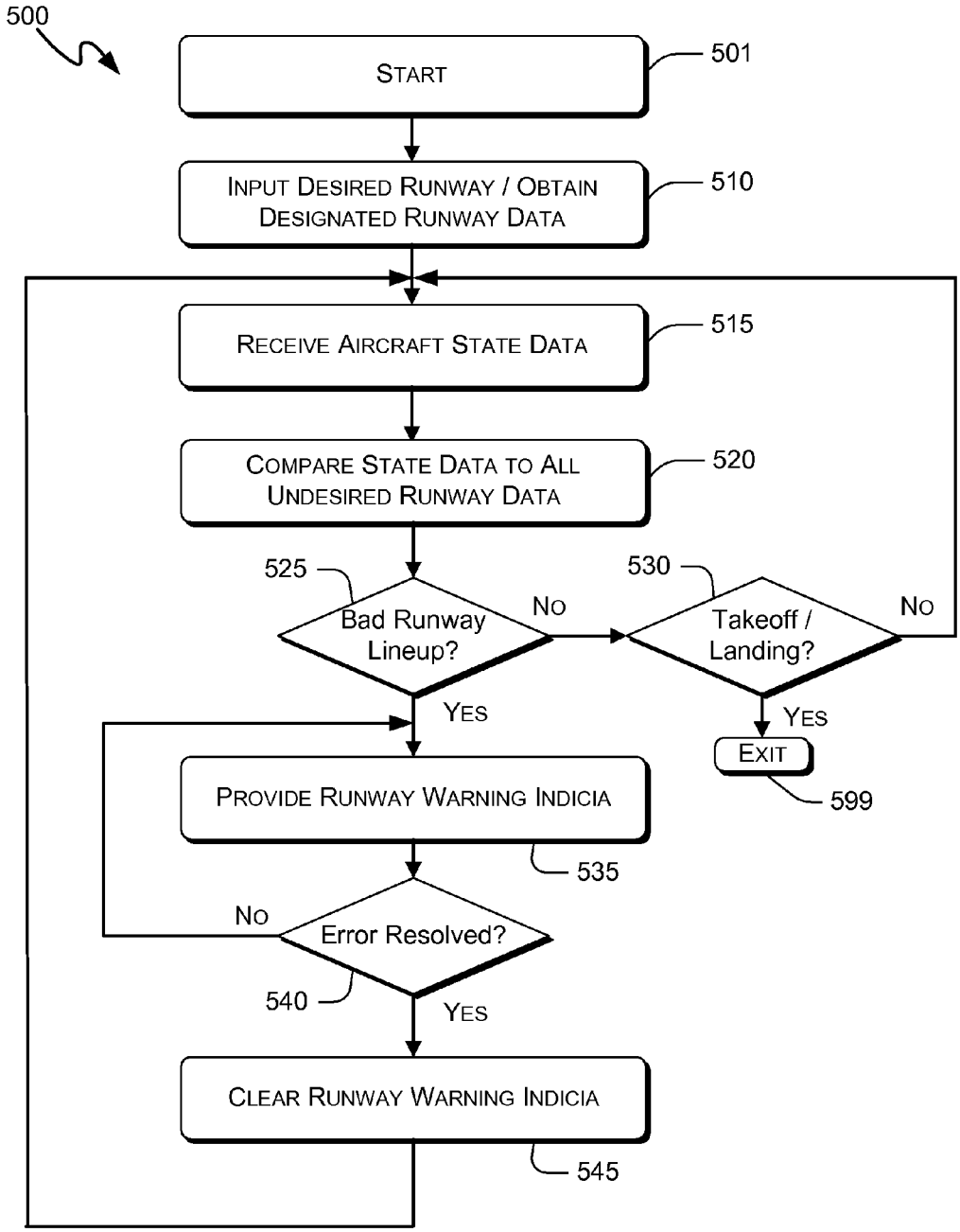
FIG. 5 is a flowchart diagram showing a process that may be employed in a runway guidance system, in accordance with systems and methods consistent with the present invention.

In that regard, turning to FIG. 5, a flow diagram of one method 500 of the present invention is provided. After a pilot determines that the host aircraft needs to traverse a runway, for example for takeoff or for landing, the pilot inputs 510 a designation of the desired runway into a data entry device. In one embodiment, the data entry device may be an integrated display with touch screen, or may comprise external keys or keypads whether separate from or integrated into a cockpit display such as the standard displays in use in commercial or general aviation. Alternatively, the designation of the appropriate and desired runway may be received by the host aircraft without need for the pilot from input, for instance by receiving such a designation from another system (for example, but not by way of limitation, a flight management system or ACARS uplink from a ground station). In another implementation, all runways in proximity to the desired runway are analyzed from airport data available in a storage device on the host aircraft, and all runways not listed as the desired runway are flagged or identified as undesirable runways for use in further analysis.

Also as part of step 510, once the desired takeoff or landing runway is designated, optionally, on the display unit, the desired runway may be rendered visually distinct on the display, such as turning the runway a different color than the default runway color (green, for instance, where the default runway color may be a shade of gray.) Optionally, a symbol indicating the host aircraft is rendered on the display, and its location on the display is updated to illustrate its position relative to the desired takeoff or landing runway as the host aircraft moves. Alternatively, different graphical indicia may be used to show the desired runway on the display, such as: a transparent box surrounding the desired runway; a cross-hatch applied over the desired runway; a shaded area applied over the desired runway; a symbol proximal an appropriate entry end of the desired runway; a solid rectangle superimposed over the desired runway; text indicating the desired runway; one or more pointer arrows illustrating a direction of takeoff or landing on the desired runway; an arrow in motion traversing the length of the desired runway in a direction indicated for takeoff or landing; an arrow indicating which direction the host aircraft needs to turn to arrive at the origin of the desired runway; one or more arrows in proximity to one or more taxiways guiding the host aircraft to the desired runway; or combinations of these approaches.

Continuing to step 515, aircraft state data is received. In one embodiment, aircraft state data may comprise the host aircraft's current position, current heading, or current speed, or any combination thereof. This data is continually updated as the aircraft moves or changes heading. The aircraft's current location may be determined by, for instance but not by way of limitation, a global positioning system input from external sensors, and the heading and/or speed data may be obtained from a standard avionics LRU (line replaceable unit) such as an Inertial Reference System (IRS). Alternatively, heading and speed information may be obtained from a Attitude and Heading Reference System (AHRS), an Air Data Attitude and Heading Reference System (ADAHRS), or calculated from multiple measurements of global position data over time. In step 520, the aircraft state data is compared to geographical information regarding all undesired runways to compute whether an alert will need to be issued in following steps. Put another way, the aircraft state data is compared to geographical information regarding all runways that are not the desired runway to compute whether an alert will need to be issued. In one embodiment, the geographical information has been pre-loaded into a storage device in the host aircraft, or alternatively, may be uplinked to the host aircraft's avionics systems via an RF link.

Next, in step 525, the determination is made whether the aircraft is preparing to enter an undesired or inappropriate runway for takeoff or landing. In one embodiment, this determination is made by examining the location of the host aircraft in relation to an entry point of an undesired runway, and if the aircraft's heading is approaching the heading necessary to take off or land on the undesired runway, the condition is triggered. Alternatively, the host aircraft's speed is considered in combination with the aircraft's proximity to the entry point of the undesired runway, and if the speed decreases to speeds consistent with takeoff or landing on the undesired runway, the condition is triggered. Thresholds for distance away from undesired runway entries, heading angular differential from undesired runway heading, and speed for entering runway entry point are predetermined. For example, but not by way of limitation, the maximum distance the aircraft may be from the entry point of an undesired runway to trigger the condition (when on the ground) may be no more than 100 feet to reduce spurious or nuisance alerts. Likewise, in one embodiment the when the angular difference between the host aircraft's current heading and the runway's orientation may be less than forty five degrees, the condition may be triggered. Alternatively, a sudden decrease in the angular difference between the host aircraft's current heading and the runway's orientation may trigger the condition (therefore indicating that the host aircraft is suddenly changing position to line up with the undesired runway—further examples are shown as illustrated in regards to FIGS. 11 and 12 below).

Continuing with FIG. 5, once the bad runway condition 525 is triggered, a runway warning indicia is provided 535. The warning may be aural, being output on a transducer such as a speaker or headphones in the cockpit of the host aircraft, or may be visual, such as being rendered on the display, or a combination thereof. Such aural alerts may comprise beeps, tones, or other sounds, or a voice message stating prohibitions such as , but not by way of limitation, "bad runway," "do not enter," "wrong runway," or "change heading to desired runway." For example, but not by way of limitation, the undesired runway may be rendered visually distinct from default runways and the desired runway. Some non-limiting examples of graphical indicia for undesired runways shown on the display include: a transparent box surrounding the undesired runway; a cross-hatch applied over the undesired runway; a shaded area applied over the undesired runway; an enlarged X symbol superimposed over the undesired runway; a solid rectangle superimposed over the undesired runway; text indicating the undesired runway; text indicating no entry onto the undesired runway; one or more arrows in proximity to one or more taxiways guiding the host aircraft away from the undesired runway and to the desired runway; and combinations thereof. Further, in one embodiment, the desired runway may be depicted in green, while the undesired runway that was considered in the triggering event 525 may be depicted in red or yellow on the display. In yet another embodiment, the color assigned to the triggered undesirable runway changes as the current heading of the host aircraft approximates the orientation of the runway; that is, color may indicate the extent to which there is a predicted hazardous runway entry. In one non-limiting example, if conditions minimally satisfied a predetermined threshold, the undesired runway may be highlighted yellow, but if the current heading of the aircraft continued towards the orientation of the undesired runway, the highlighting may be changed to red.

Once the pilot makes corrections to avoid using the undesired runway 540, the indicia that announce the alert are cleared 545; otherwise, the alerts continue 535 until manually cleared by the pilot or by the state of the aircraft changing to indicate avoidance of the undesired runway. Once the warning alerts or indicia are cleared 545, the process continues with the monitoring of aircraft state data 515. If an undesired or bad runway condition test 525 was not triggered as described above, then the process continues until either takeoff or landing 530 is achieved 599. Otherwise, the process continues with monitoring of the aircraft state data 515.

Figure 6:
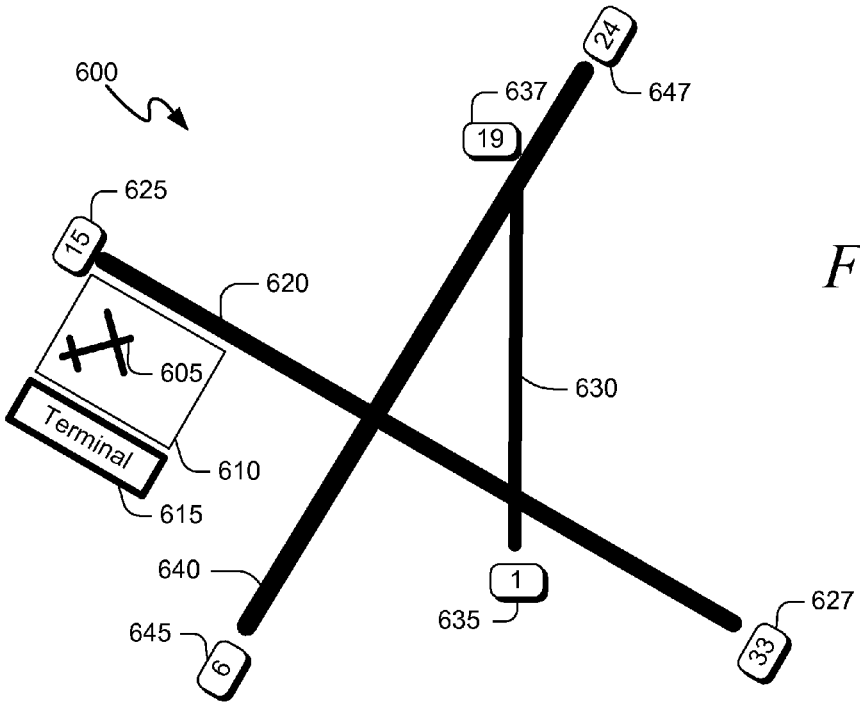
FIG. 6 is a depiction of a simplified map view of an airport as may be rendered on a host aircraft display, in accordance with systems and methods consistent with the present invention.

Turning to FIG. 6, a depiction is shown of a simplified map view 600 of an airport as may be rendered on a host aircraft display, in accordance with systems and methods consistent with the present invention. The map shown in FIG. 6 is illustrative only, and an actual airport map when rendered on the display may also include such graphical elements as taxiways, additional navigation aids, parking lots, outbuildings, and the like. The host aircraft 605 is shown on the ground positioned on a ramp 610 in proximity to a terminal 615, and through taxiways (not shown) has access to three runways 620, 630, 640 from runway entry points 625, 627, 635, 637, 645, 647. Alternatively the aircraft 605 could be shown on approach to land on a designated runway.

Figure 7:
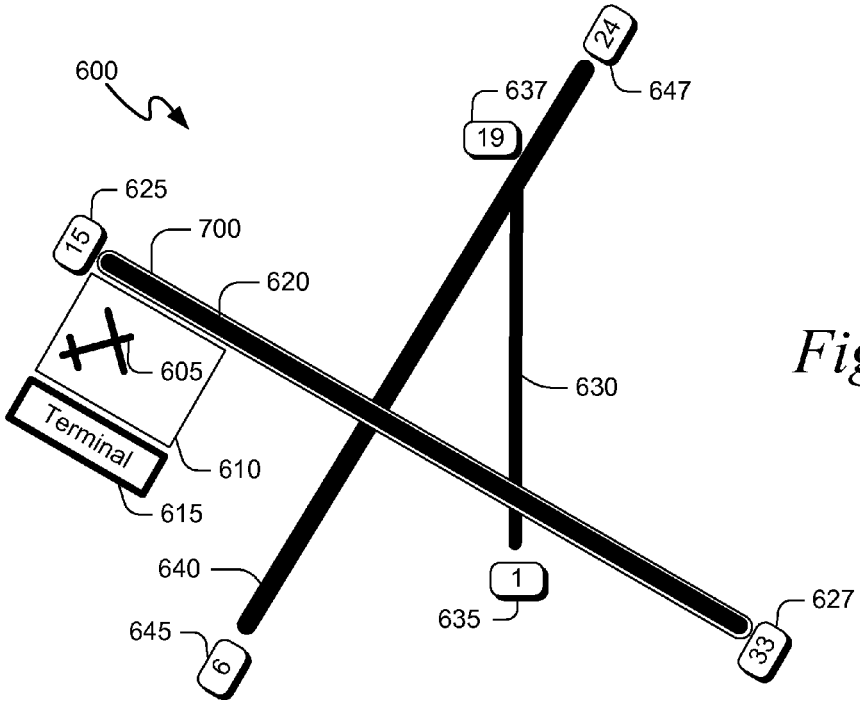
FIG. 7 is a depiction of a simplified map view of an airport as may be rendered on a host aircraft display, with a desired runway highlighted, in accordance with systems and methods consistent with the present invention.

Turning to FIG. 7, the host aircraft 605 has received instructions to taxi to runway 33 (627). The desired runway 620 and/or runway entry point 627 are entered by the pilot through a keyboard or touch screen, or by downlink from an external source as described above. In the illustrated embodiment, after selection, the desired runway is highlighted through an external box 700 placed around the desired runway. Alternatively, the appropriate end 627 of the runway 620 could be highlighted as well (not shown). Additional or alternative indicia could be utilized to depict 700 the desired runway, such as those indicia discussed above in regards to FIG. 5.

Figure 8:
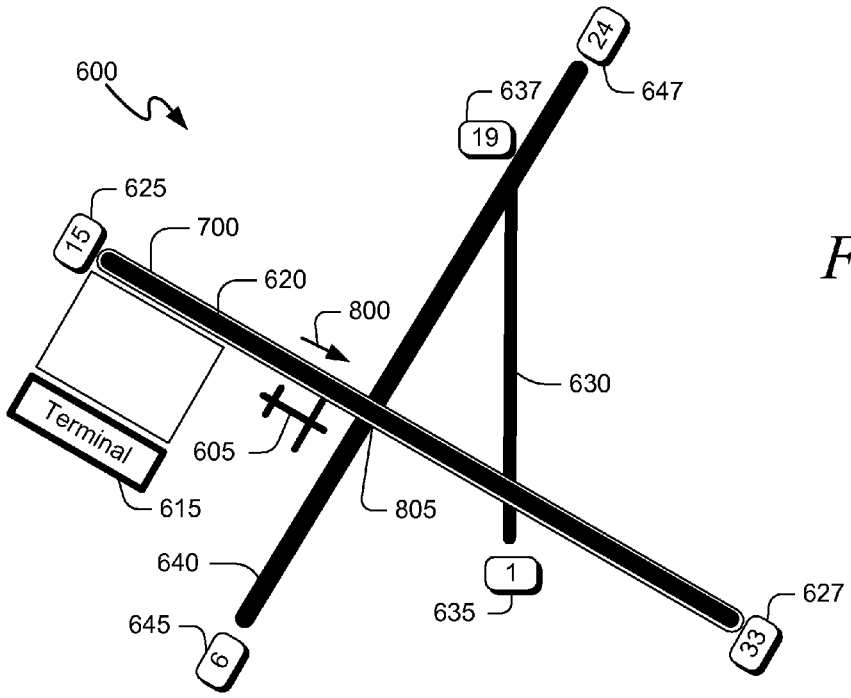
FIG. 8 is a depiction of a simplified map view of an airport as may be rendered on a host aircraft display, with a desired runway highlighted and a depiction of the host aircraft approaching a runway entry point in accordance with systems and methods consistent with the present invention.

Turning to FIG. 8, the host aircraft 605 is shown taxiing in a direction 800 towards the desired runway entry point 627, and approaching an intersection 805 of runways 620, 640. Because the heading of the aircraft 605 is consistent with traversal of the runway 620, and not with the undesired runway 640, an alert is not triggered even though the aircraft is in proximity to an entry 805 to the inappropriate runway. Also note that because the heading of the host aircraft 605 is away from the wrong end 625 of the desired runway 620, an alert is not triggered (additionally, the host aircraft 605, at the location shown, may be too far from the wrong end 625 of the desired runway 620, that is, its distance is greater than a predetermined threshold to trigger an alert, even if it was oriented at the right heading to enter runway 620 from the inappropriate end 625).

Figure 9:
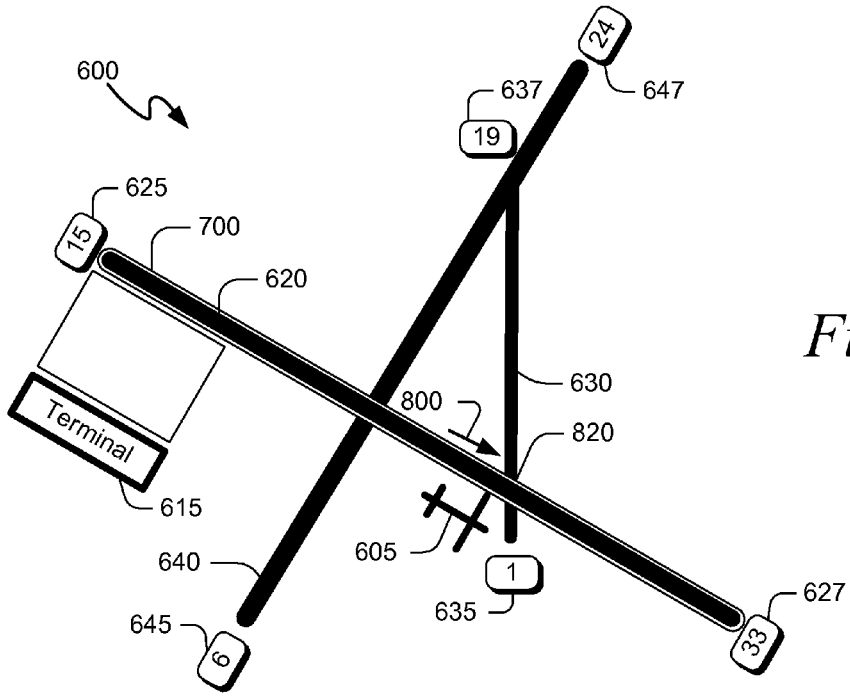
FIG. 9 is a depiction of a simplified map view of an airport as may be rendered on a host aircraft display, with a desired runway highlighted and a depiction of the host aircraft approaching a second runway entry point in accordance with systems and methods consistent with the present invention.
Figure 10:
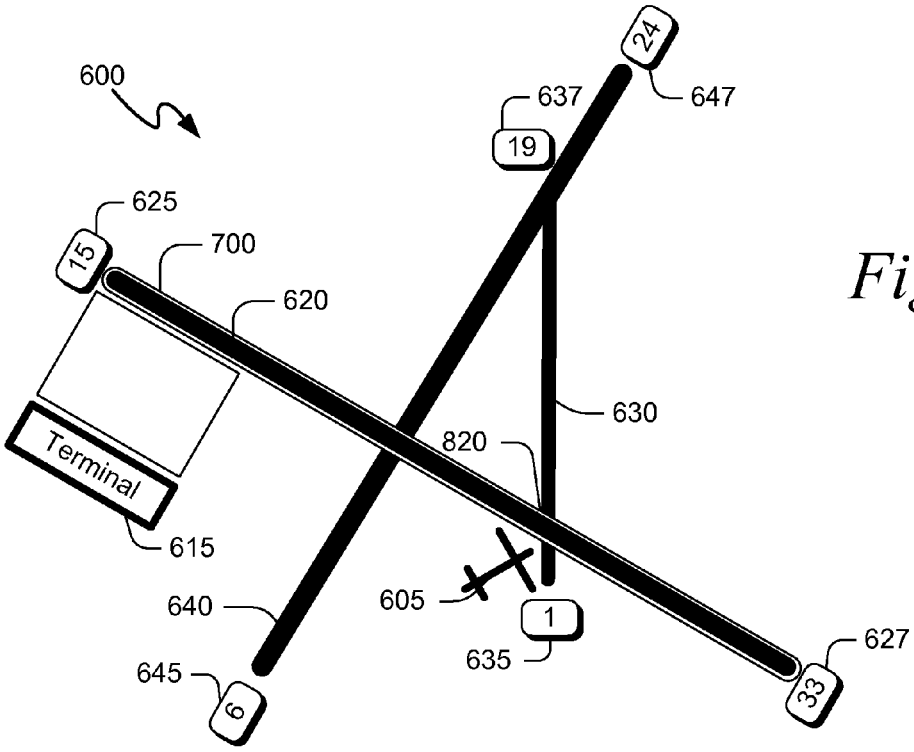
FIG. 10 is a depiction of a simplified map view of an airport as may be rendered on a host aircraft display, with a desired runway highlighted and a depiction of the host aircraft turning to enter an undesired runway in accordance with systems and methods consistent with the present invention.

In FIG. 9, the host aircraft 605 continues 800 its taxi towards the desired runway 620 entry point 627, and approaches a second intersection 820 between runways 620, 630. Again, because the heading of the aircraft is consistent with traversal of or travel to the desired runway 620, no alert is generated even though the aircraft is in proximity to an undesired runway's entry point. However, turning to FIG. 10, the aircraft 605 begins turning in a direction that may allow traversal down an undesired runway 630. In the illustrative embodiment shown, because the heading of aircraft 605 is not yet close to that required to traverse the undesired runway 630, no alert is generated; however the predetermined threshold may be selected to increase or decrease the sensitivity to alignment conditions, depending on the level of nuisance alert suppression that is desired. In an alternate embodiment (not shown) if the aircraft had neared or entered the entry point 820 to the undesired runway 630, that is, if its distance to the entry point 820 was below a predetermined threshold value, and if the aircraft stopped moving regardless of its current heading, a condition could be triggered that issues an alert not to enter the undesired runway 630. Such a triggering condition could be useful in providing alerts if the pilot is preparing to take off on the undesired runway 630, or if the pilot became disoriented and stopped to determine which runway to utilize, at which time guidance may be helpful to assist the pilot to reach the proper entry point 627 of the desired runway 620.

Figure 11:
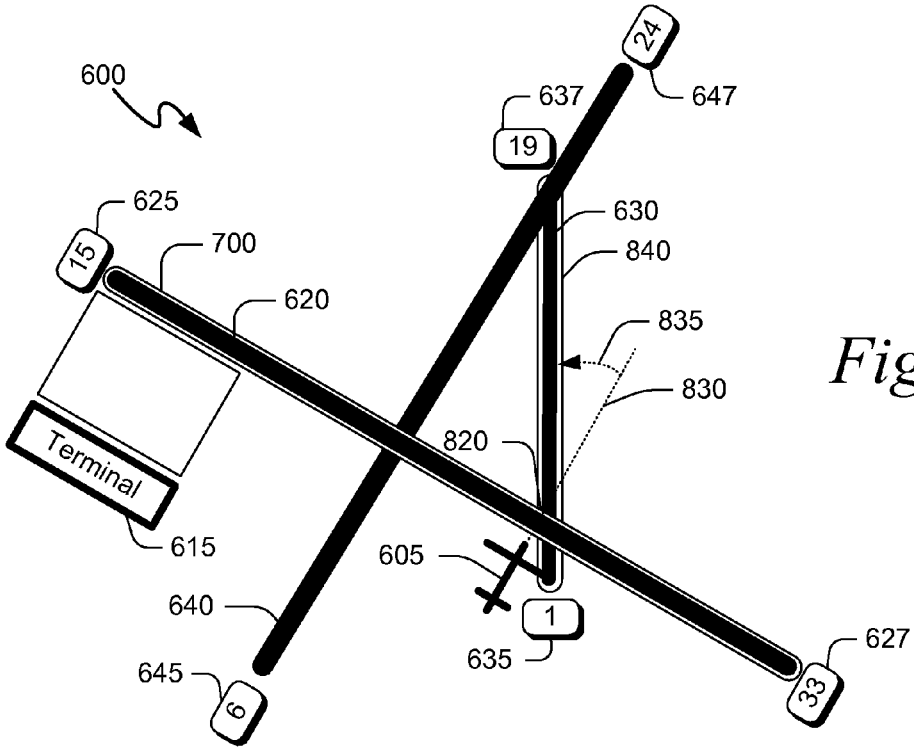
FIG. 11 is a depiction of a simplified map view of an airport as may be rendered on a host aircraft display, with a desired runway highlighted and a depiction of the host aircraft turning to enter an undesired runway, and the undesired runway highlighted in accordance with systems and methods consistent with the present invention.

Continuing on to FIG. 11, the aircraft 605 has turned to a heading that is beginning to approach the directional orientation of the undesired runway 630, and an alert has been generated because the following two conditions are true: (1) the aircraft is below a predetermined threshold distance to an entry point 820 of an undesired runway 630, and (2) the aircraft's heading 830 has begun to approximate the orientation of the undesired runway 630, that is the angular difference 835, is below a predetermined threshold value. In one alternate embodiment, the rate of change of the angular difference 835 of the aircraft's heading 830 is above a predetermined threshold, indicating that the aircraft is orienting itself for entry onto the undesired runway 630. Once the alert condition has been triggered, visual and/or aural alerts are provided, and on FIG. 11, a box 840 has been placed around undesired runway 630, indicating it is an inappropriate or undesired runway. In one embodiment, the box 840 is a different color, such as red, than the desired runway highlight box 700, which may be a color such as green. Additional or alternative indicia showing the undesired runway could be displayed in proximity to the undesired runway 630 as described above in regards to FIG. 5.

Figure 12:
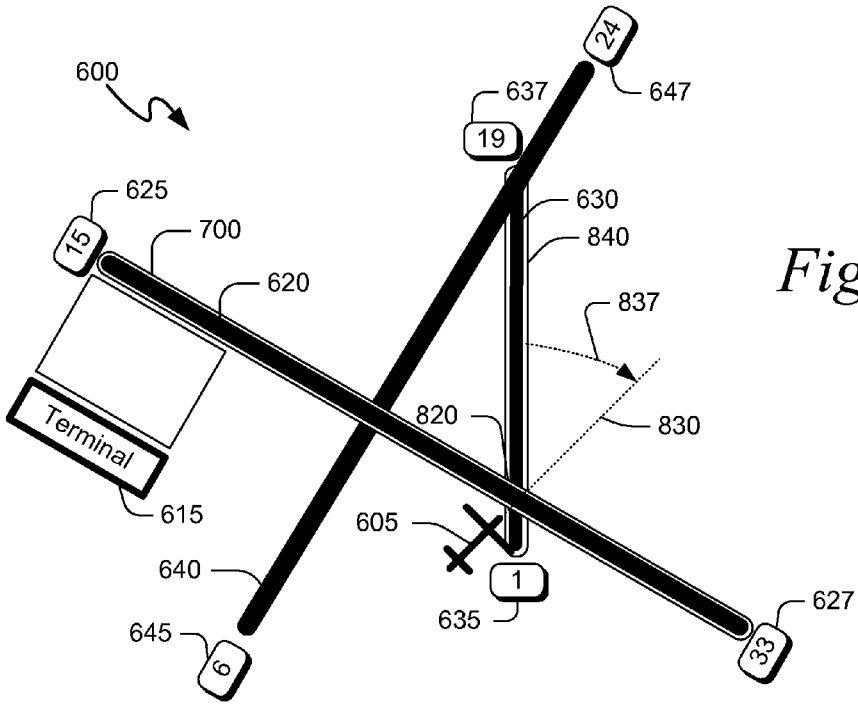
FIG. 12 is a depiction of a simplified map view of an airport as may be rendered on a host aircraft display, with a desired runway highlighted and a depiction of the host aircraft turning to avoid entry into an undesired runway, and the undesired runway highlighted in accordance with systems and methods consistent with the present invention.
Figure 13:
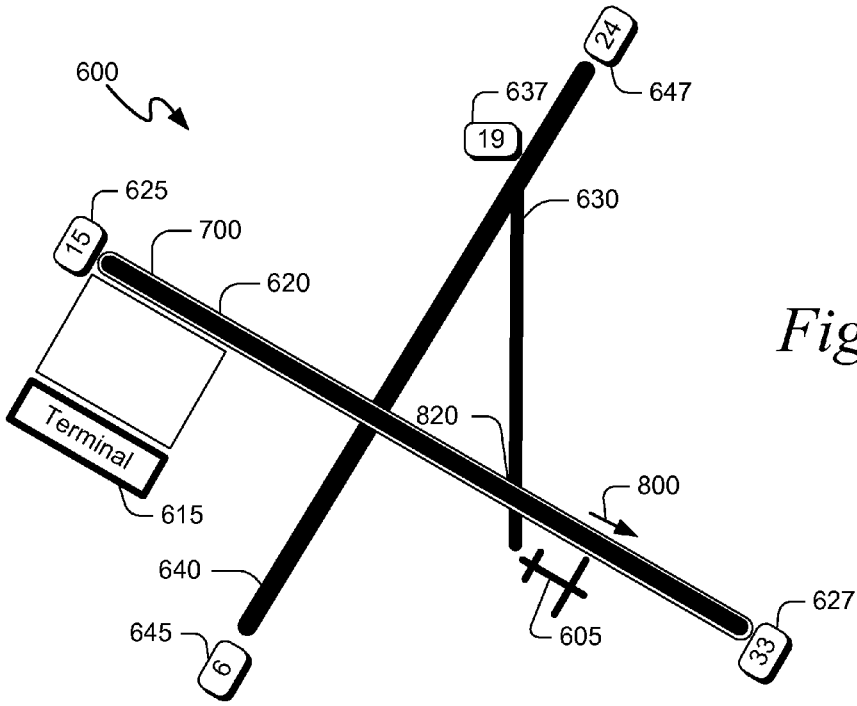
FIG. 13 is a depiction of a simplified map view of an airport as may be rendered on a host aircraft display, with a depiction of the host aircraft resuming its taxi to entry of the desired runway in accordance with systems and methods consistent with the present invention.

Turning to FIG. 12, once the pilot has received the alert, the pilot of the aircraft 605 revises course or turns away from the heading 830 that approximates the orientation of the undesired runway 630. As the threshold for angular difference 837 between the heading 830 and the undesired runway 630 orientation has not yet exceeded a predetermined threshold, the undesired runway continues to be highlighted with an alert 840. However, once the heading/orientation difference angle 837 has exceeded a predetermined threshold, or if the distance between the aircraft 605 and the undesired runway entry 820 has exceeded a predetermined threshold, the alert is terminated and graphical indicia 840 removed, as shown in FIG. 13, with the aircraft 605, once again taxiing 800 toward the entry point 627 to the desired runway 620. In the alternative, if the rate of change angular difference 837 exceeds a predetermined threshold value, indicating aircraft 605 is rapidly changing heading 830 away from the orientation of the undesired runway 630, the alert may be terminated.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A runway alert system for a host aircraft, the system comprising:

a processor for executing one or more instructions that implement one or more functions of the runway alert system;

a data storage device including geographical runway information;

a receiver for obtaining current location data of the host aircraft;

an apparatus to provide a current heading of the host aircraft;

a data entry device for receiving data indicating a desired runway; and memory for storing the one or more instructions for execution by the processor to implement the one or more functions of the runway alert system to:

receive the identity of the desired runway;

provide an indicia of:

the desired runway; and the position of the host aircraft in relation to the desired runway;

determine that the host aircraft is being positioned for traversing an undesired runway;

determine from the current location data, the current heading, the identity of the desired runway, and the geographical runway information, that a predetermined threshold has been satisfied, and thereupon, providing within the host aircraft one or more of an aural alert or a visual alert; and determine that:

the host aircraft is within a predetermined proximity of an undesired runway; and the angular difference between the current heading and the heading necessary to traverse on the undesired runway is within a predetermined heading difference threshold.

2. The runway alert system for a host aircraft as defined in claim 1, further comprising an inertial reference configured to provide a current speed of the host aircraft, and wherein memory stores further instructions for execution by the processor to implement the one or more functions of the runway alert system to determine that:

the host aircraft is within a predetermined proximity of an undesired runway; and the current speed of the host aircraft drops below a predetermined pre-takeoff threshold.

3. The runway alert system for a host aircraft as defined in claim 1, further comprising a display for illustrating a current position of the host aircraft in relation to at least one runway; and wherein memory stores further instructions for execution by the processor to implement the one or more functions of the runway alert system to render on the display a depiction of an undesired runway in a manner graphically distinct from the desired runway.

4. The runway alert system for a host aircraft as defined in claim 3, wherein memory stores further instructions for execution by the processor to implement the one or more functions of the runway alert system to render, on the display, the desired runway in a color different from a default runway color.

5. The runway alert system for a host aircraft as defined in claim 3, wherein memory stores further instructions for execution by the processor to implement the one or more functions of the runway alert system to render, on the display, the desired runway in a color different from a default runway color, and an undesired runway in a color different from the default runway color and the desired runway color.

6. The runway alert system for a host aircraft as defined in claim 1, wherein the apparatus further comprises an inertial reference system for providing current heading and current speed of the host aircraft.

7. A runway alert system for a host aircraft on the ground, the system comprising:

a processor for executing one or more instructions that implement one or more functions of the runway alert system;

a data storage device including at least 2-dimensional geographical airport runway and taxiway information;

a receiver for obtaining current location data of the host aircraft;

means for obtaining a current heading and ground speed of the host aircraft;

a data entry device for receiving data indicating a desired runway;

a transducer for providing aural alerts;

a display for illustrating a current position of the host aircraft in relation to at least one runway; and memory for storing the one or more instructions for execution by the processor to implement the one or more functions of the runway alert system to:

receive the identity of the desired runway;

render, on the display:

a depiction of an overhead map of an airport including the desired runway;

a position of the host aircraft in relation to the desired runway;

determine that a predetermined threshold has been satisfied, and thereupon, providing within the host aircraft one or more of an aural alert or a visual alert; and determine that:

the host aircraft is within a predetermined proximity of an undesired runway; and the angular difference between the current heading and the heading necessary to traverse the undesired runway is within a predetermined heading difference threshold.

8. The runway alert system for a host aircraft on the ground as defined in claim 7, wherein memory stores further instructions for execution by the processor to implement the one or more functions of the runway alert system to determine that:

the host aircraft is within a predetermined proximity of an undesired runway; and the current ground speed of the host aircraft drops below a predetermined pre-takeoff threshold.

9. The runway alert system for a host aircraft on the ground as defined in claim 7, wherein memory stores further instructions for execution by the processor to implement the one or more functions of the runway alert system to determine a criterion selected from the group consisting of:

the host aircraft is within a predetermined proximity to the entry point of an undesired runway;

the angular difference between the current heading and the heading necessary to traverse on the undesired runway is within a predetermined heading difference threshold;

the current ground speed of the host aircraft drops below a predetermined pre-takeoff threshold; and combinations thereof.

10. The runway alert system for a host aircraft on the ground as defined in claim 7, wherein memory stores further instructions for execution by the processor to implement the one or more functions of the runway alert system to render on the display a predetermined graphical element in proximity to the desired runway.

11. The runway alert system for a host aircraft on the ground as defined in claim 10, wherein the graphical element is selected from the group consisting of:

a transparent box surrounding the desired runway;

a cross-hatch applied over the desired runway;

a shaded area applied over the desired runway;

a symbol proximal an appropriate takeoff origin end of the desired runway;

a solid rectangle superimposed over the desired runway;

text indicating the desired runway;

one or more pointer arrows illustrating a direction of takeoff on the desired runway;

an arrow in motion traversing the length of the desired runway in a direction indicated for takeoff;

an arrow indicating which direction the host aircraft needs to turn to arrive at the origin of the desired runway;

one or more arrows in proximity to one or more taxiways guiding the host aircraft to the desired runway; and combinations thereof.

12. The runway alert system for a host aircraft on the ground as defined in claim 7, wherein memory stores further instructions for execution by the processor to implement the one or more functions of runway alert system to render on the display a predetermined graphical element in proximity to an undesired runway.

13. The runway alert system for a host aircraft on the ground as defined in claim 12, wherein the graphical element is selected from the group consisting of:

a transparent box surrounding the undesired runway;

a cross-hatch applied over the undesired runway;

a shaded area applied over the undesired runway;

an enlarged X symbol superimposed over the undesired runway;

a solid rectangle superimposed over the undesired runway;

text indicating the undesired runway;

text indicating no entry onto the undesired runway;

one or more arrows in proximity to one or more taxiways guiding the host aircraft away from the undesired runway and to the desired runway; and combinations thereof.

14. The runway alert system for a host aircraft on the ground as defined in claim 7, wherein memory stores further instructions for execution by the processor to implement the one or more functions of the runway alert system to render, on the display, the desired runway in a color different from a default runway color, and an undesired runway in a color different from the default runway color and the desired runway color.

15. A method for providing runway guidance for a host aircraft, the method comprising:

receiving an indication of a desired takeoff or landing runway;

obtaining a current position of the host aircraft;

determining whether a predefined condition is satisfied; and outputting an alert selected from the group consisting of:

changing an appearance of a display in the host aircraft to indicate that the predefined condition is satisfied;

issuing an aural alert to crewmembers of the host aircraft to indicate that the predefined condition is satisfied; and combinations thereof;

wherein said determining step further comprises:

accessing a database of airport runways to obtain geographical location information of one or more runways;

designating all runways at an airport that do not match the indication of desired takeoff or landing runway as undesired runways;

obtaining the current location and current heading of the host aircraft; and determining that the host aircraft:

is within a predetermined distance of an entrance to one of the undesired runways; and is assuming a heading that would allow an aircraft to traverse the one of the undesired runways.

16. The method as defined in claim 15 further comprising providing an aural alert upon satisfaction of the predetermined condition.

17. The method as defined in claim 15, wherein the changing an appearance of a display step further comprises rendering, on the display, a graphical element selected from the group consisting of:

a transparent box surrounding the undesired runway;

a cross-hatch applied over the undesired runway;

a shaded area applied over the undesired runway;

an enlarged X symbol superimposed over the undesired runway;

a solid rectangle superimposed over the undesired runway;

text indicating the undesired runway;

text indicating no entry onto the undesired runway;

one or more arrows in proximity to one or more taxiways guiding the host aircraft away from the undesired runway and to the desired runway; and combinations thereof.

18. The method as defined in claim 15, further comprising rendering, on the display, a graphical element selected from the group consisting of:

a transparent box surrounding the desired takeoff or landing runway;

a cross-hatch applied over the desired takeoff or landing runway;

a shaded area applied over the desired takeoff or landing runway;

a symbol proximal an appropriate origin end of the desired takeoff or landing runway;

a solid rectangle superimposed over the desired takeoff or landing runway;

text indicating the desired takeoff or landing runway;

one or more pointer arrows illustrating a direction of takeoff or landing on the desired takeoff or landing runway;

an arrow in motion traversing the length of the desired takeoff or landing runway in a respective direction indicated for takeoff or landing;

an arrow indicating which direction the host aircraft needs to turn to arrive at the origin of the desired takeoff or landing runway;

one or more arrows in proximity to one or more taxiways guiding the host aircraft to the desired runway; and combinations thereof.

19. A runway alert system for a host aircraft, the system comprising:

a processor for executing one or more instructions that implement one or more functions of the runway alert system;

a data storage device including geographical runway information;

a receiver for obtaining current location data of the host aircraft;

an apparatus to provide a current heading of the host aircraft;

a data entry device for receiving data indicating a desired runway;

memory for storing the one or more instructions for execution by the processor to implement the one or more functions of the runway alert system to:

receive the identity of the desired runway;

provide an indicia of:

the desired runway; and the position of the host aircraft in relation to the desired runway;

determine that the host aircraft is being positioned for traversing an undesired runway; and determine from the current location data, the current heading, the identity of the desired runway, and the geographical runway information, that a predetermined threshold has been satisfied, and thereupon, providing within the host aircraft one or more of an aural alert or a visual alert; and an inertial reference configured to provide a current speed of the host aircraft, and wherein memory stores further instructions for execution by the processor to implement the one or more functions of the runway alert system to determine that:

the host aircraft is within a predetermined proximity of an undesired runway; and the current speed of the host aircraft drops below a predetermined pre-takeoff threshold.

20. The runway alert system for a host aircraft as defined in claim 19, wherein memory stores further instructions for execution by the processor to implement the one or more functions of the runway alert system to determine that:

the host aircraft is within a predetermined proximity of an undesired runway; and the angular difference between the current heading and the heading necessary to traverse on the undesired runway is within a predetermined heading difference threshold.

21. The runway alert system for a host aircraft as defined in claim 19, wherein the apparatus further comprises an inertial reference system for providing current heading and current speed of the host aircraft.

22. The runway alert system for a host aircraft as defined in claim 19, further comprising a display for illustrating a current position of the host aircraft in relation to at least one runway; and wherein memory stores further instructions for execution by the processor to implement the one or more functions of the runway alert system to render on the display a depiction of an undesired runway in a manner graphically distinct from the desired runway.

23. The runway alert system for a host aircraft as defined in claim 22, wherein memory stores further instructions for execution by the processor to implement the one or more functions of the runway alert system to render, on the display, the desired runway in a color different from a default runway color.

24. The runway alert system for a host aircraft as defined in claim 22, wherein memory stores further instructions for execution by the processor to implement the one or more functions of the runway alert system to render, on the display, the desired runway in a color different from a default runway color, and an undesired runway in a color different from the default runway color and the desired runway color.

25. A runway alert system for a host aircraft on the ground, the system comprising:

a processor for executing one or more instructions that implement one or more functions of the runway alert system;

a data storage device including at least 2-dimensional geographical airport runway and taxiway information;

a receiver for obtaining current location data of the host aircraft;

means for obtaining a current heading and ground speed of the host aircraft;

a data entry device for receiving data indicating a desired runway;

a transducer for providing aural alerts;

a display for illustrating a current position of the host aircraft in relation to at least one runway; and memory for storing the one or more instructions for execution by the processor to implement the one or more functions of the runway alert system to:

receive the identity of the desired runway;

render, on the display:

a depiction of an overhead map of an airport including the desired runway;

a position of the host aircraft in relation to the desired runway;

determine that a predetermined threshold has been satisfied, and thereupon, providing within the host aircraft one or more of an aural alert or a visual alert; and determine that:

the host aircraft is within a predetermined proximity of an undesired runway; and the current ground speed of the host aircraft drops below a predetermined pre-takeoff threshold.

26. The runway alert system for a host aircraft on the ground as defined in claim 25, wherein memory stores further instructions for execution by the processor to implement the one or more functions of the runway alert system to determine that:

the host aircraft is within a predetermined proximity of an undesired runway; and the angular difference between the current heading and the heading necessary to traverse the undesired runway is within a predetermined heading difference threshold.

27. The runway alert system for a host aircraft on the ground as defined in claim 25, wherein memory stores further instructions for execution by the processor to implement the one or more functions of the runway alert system to determine a criterion selected from the group consisting of:

the host aircraft is within a predetermined proximity to the entry point of an undesired runway;

the angular difference between the current heading and the heading necessary to traverse on the undesired runway is within a predetermined heading difference threshold;

the current ground speed of the host aircraft drops below a predetermined pre-takeoff threshold; and combinations thereof.

28. The runway alert system for a host aircraft on the ground as defined in claim 25, wherein memory stores further instructions for execution by the processor to implement the one or more functions of the runway alert system to render on the display a predetermined graphical element in proximity to the desired runway.

29. The runway alert system for a host aircraft on the ground as defined in claim 28, wherein the graphical element is selected from the group consisting of:

a transparent box surrounding the desired runway;

a cross-hatch applied over the desired runway;

a shaded area applied over the desired runway;

a symbol proximal an appropriate takeoff origin end of the desired runway;

a solid rectangle superimposed over the desired runway;

text indicating the desired runway;

one or more pointer arrows illustrating a direction of takeoff on the desired runway;

an arrow in motion traversing the length of the desired runway in a direction indicated for takeoff;

an arrow indicating which direction the host aircraft needs to turn to arrive at the origin of the desired runway;

one or more arrows in proximity to one or more taxiways guiding the host aircraft to the desired runway; and combinations thereof.

30. The runway alert system for a host aircraft on the ground as defined in claim 25, wherein memory stores further instructions for execution by the processor to implement the one or more functions of runway alert system to render on the display a predetermined graphical element in proximity to an undesired runway.

31. The runway alert system for a host aircraft on the ground as defined in claim 30, wherein the graphical element is selected from the group consisting of:

a transparent box surrounding the undesired runway;

a cross-hatch applied over the undesired runway;

a shaded area applied over the undesired runway;

an enlarged X symbol superimposed over the undesired runway;

a solid rectangle superimposed over the undesired runway;

text indicating the undesired runway;

text indicating no entry onto the undesired runway;

one or more arrows in proximity to one or more taxiways guiding the host aircraft away from the undesired runway and to the desired runway; and combinations thereof.

32. The runway alert system for a host aircraft on the ground as defined in claim 25, wherein memory stores further instructions for execution by the processor to implement the one or more functions of the runway alert system to render, on the display, the desired runway in a color different from a default runway color, and an undesired runway in a color different from the default runway color and the desired runway color.

33. A runway alert system for a host aircraft on the ground, the system comprising:

a processor for executing one or more instructions that implement one or more functions of the runway alert system;

a data storage device including at least 2-dimensional geographical airport runway and taxiway information;

a receiver for obtaining current location data of the host aircraft;

means for obtaining a current heading and ground speed of the host aircraft;

a data entry device for receiving data indicating a desired runway;

a transducer for providing aural alerts;

a display for illustrating a current position of the host aircraft in relation to at least one runway; and memory for storing the one or more instructions for execution by the processor to implement the one or more functions of the runway alert system to:

receive the identity of the desired runway;

render, on the display:

a depiction of an overhead map of an airport including the desired runway;

a position of the host aircraft in relation to the desired runway; and determine that a predetermined threshold has been satisfied, and thereupon, providing within the host aircraft one or more of an aural alert or a visual alert; and determine a criterion selected from the group consisting of:

the host aircraft is within a predetermined proximity to the entry point of an undesired runway;

the angular difference between the current heading and the heading necessary to traverse on the undesired runway is within a predetermined heading difference threshold;

the current ground speed of the host aircraft drops below a predetermined pre-takeoff threshold; and combinations thereof.

34. The runway alert system for a host aircraft on the ground as defined in claim 33, wherein memory stores further instructions for execution by the processor to implement the one or more functions of the runway alert system to determine that:

the host aircraft is within a predetermined proximity of an undesired runway; and the angular difference between the current heading and the heading necessary to traverse the undesired runway is within a predetermined heading difference threshold.

35. The runway alert system for a host aircraft on the ground as defined in claim 33, wherein memory stores further instructions for execution by the processor to implement the one or more functions of the runway alert system to determine that:

the host aircraft is within a predetermined proximity of an undesired runway; and the current ground speed of the host aircraft drops below a predetermined pre-takeoff threshold.

36. The runway alert system for a host aircraft on the ground as defined in claim 33, wherein memory stores further instructions for execution by the processor to implement the one or more functions of the runway alert system to render on the display a predetermined graphical element in proximity to the desired runway.

37. The runway alert system for a host aircraft on the ground as defined in claim 36, wherein the graphical element is selected from the group consisting of:

a transparent box surrounding the desired runway;

a cross-hatch applied over the desired runway;

a shaded area applied over the desired runway;

a symbol proximal an appropriate takeoff origin end of the desired runway;

a solid rectangle superimposed over the desired runway;

text indicating the desired runway;

one or more pointer arrows illustrating a direction of take-off on the desired runway;

an arrow in motion traversing the length of the desired runway in a direction indicated for takeoff;

an arrow indicating which direction the host aircraft needs to turn to arrive at the origin of the desired runway;

one or more arrows in proximity to one or more taxiways guiding the host aircraft to the desired runway; and combinations thereof.

38. The runway alert system for a host aircraft on the ground as defined in claim 33, wherein memory stores further instructions for execution by the processor to implement the one or more functions of runway alert system to render on the display a predetermined graphical element in proximity to an undesired runway.

39. The runway alert system for a host aircraft on the ground as defined in claim 38, wherein the graphical element is selected from the group consisting of:

a transparent box surrounding the undesired runway;

a cross-hatch applied over the undesired runway;

a shaded area applied over the undesired runway;

an enlarged X symbol superimposed over the undesired runway;

a solid rectangle superimposed over the undesired runway;

text indicating the undesired runway;

text indicating no entry onto the undesired runway;

one or more arrows in proximity to one or more taxiways guiding the host aircraft away from the undesired runway and to the desired runway; and combinations thereof.

40. The runway alert system for a host aircraft on the ground as defined in claim 33, wherein memory stores further instructions for execution by the processor to implement the one or more functions of the runway alert system to render, on the display, the desired runway in a color different from a default runway color, and an undesired runway in a color different from the default runway color and the desired runway color.

* * * * *